United States Patent [19]

Weiss

[11] 3,936,367

[45] Feb. 3, 1976

[54] METHOD OF PRODUCING A LAYER OF DARK COLORED HEAT RADIATING INSULATING MATERIAL FOR HEATERS OF INDIRECTLY HEATED CATHODES

[75] Inventor: Eberhard Weiss, Stuttgart, Germany

[73] Assignee: International Standard Electric Corporation, New York, N.Y.

[22] Filed: Dec. 18, 1974

[21] Appl. No.: 534,027

[30] Foreign Application Priority Data

Dec. 22, 1973 Germany ..... 2364403

[52] U.S. Cl. ..... 204/181

[51] Int. Cl.[2] ..... C25D 13/02

[58] Field of Search ..... 204/181

[56] References Cited

UNITED STATES PATENTS 2,734,857 2/1956 Snyder ..... 204/181

FOREIGN PATENTS OR APPLICATIONS 1,177,489 1/1970 United Kingdom ..... 204/181

*Primary Examiner*—Howard S. Williams

*Attorney, Agent, or Firm*—John T. O'Halloran; Menotti J. Lombardi, Jr.

[57] ABSTRACT

Heater for indirectly heated cathodes with a homogeneous dark colored insulating layer which is formed by introducing aluminum oxide, tungsten oxide and chromium oxide, all in powder form, into a coating bath and coating the heaters in a combined electrophoretic-electrolytic process by dipping them into the bath only once.

Advantages: simplified production (only one coating process); improved heat radiation; short heating time; longer service life.

2 Claims, No Drawings

METHOD OF PRODUCING A LAYER OF DARK COLORED HEAT RADIATING INSULATING MATERIAL FOR HEATERS OF INDIRECTLY HEATED CATHODES

The present invention relates to a method of producing a layer of dark colored heat radiating insulating material for heaters of indirectly heated cathodes.

It is known from earlier publications, such as German Pat. No. 1,141,388, German Application Ser. No. 1,183,602 and German application Ser. No. 2,230,750, that aluminum oxide which is deposited electrophoretically in a coating bath or by being sprayed onto the filament forms a compact, white, highly insulating layer. A disadvantage lies in the fact that due to the white color the heat radiation of the insulating layer can hardly be utilized for the heat transfer from the filament to the cathode sleeve carrying the emitting layer.

According to the above publications, the filament is generally first coated with an insulating layer of alumina on which a second layer is then deposited which consists of a mixture of alumina and a dark-coloring additive, preferably tungsten. This does not, however, result in a decisive improvement with respect to heat radiation.

Homogeneous dark coloring of the insulating layer is not suggested in those publications because this was obviously possible only at the expense of the electrical insulating properties and of the service life.

A method has been proposed wherein the heaters of indirectly heated cathodes can be covered with a homogeneous dark colored coating of insulating material without adversely affecting the electrical insulating properties or the service life.

In that method, the coating of the heaters is carried out in two process steps. First, the heaters are coated electrophoretically with aluminum oxide. Then, in a second step, they are homogeneously blackened by being dipped into an aqueous ammonium-tungstate solution.

It is the object of the present invention to provide a method of producing an electrically insulating coating for heaters of indirectly heated cathodes which is as simple as possible and wherein the advantage of the pure aluminum oxide regarding the electrical insulating properties is preserved, while the thermal properties are improved in comparison with the prior art known from the publications.

The invention is characterized in that aluminum-oxide powder is intimately mixed with tungsten-oxide powder and chromium-oxide powder, that a coating bath is prepared with said mixture and additions of aluminum nitrate, magnesium nitrate, ethanol and water, that the heaters dipped into said coating bath are coated electrophoretically with a porous, dark colored heat radiating layer of insulating material, with electrolysis taking place simultaneously, and that the heaters are then rinsed, in known manner, in a suitable liquid such as methanol, dried, and finally sintered in a nitrogen-hydrogen atmosphere at about 1,600°C.

Regarding the thermal and mechanical properties of the layer of insulating material, experiments have shown that it is particularly advantageous if the powdery mixture consists of about 86% by weight of aluminum oxide, about 10% by weight of tungsten oxide, and about 4% by weight of chromium oxide.

The method in accordance with the invention and the heaters manufactured by this method have several advantages over the methods and heaters disclosed in the prior art. While the conventional, outwardly blackened heaters require two or three coating processes, in the method according to the invention a homogeneous dark colored, elastic coating is produced on the heaters in only one coating process. Insulating properties, service life and heat radiation are improved. The emissive power remains equally high for the entire service life while being reduced in the case of the outwardly blackened heaters because of the decomposition of the outer, dark colored heat radiating layer. Because of their short heating time, the heaters in accordance with the invention are also suitable for use in the so-called fast-heating cathodes. The short heating time is due to the fact that, because of the homogeneous dark coloring of the insulating layer, the latter's heat radiation is higher throughout than in the case of the prior art heaters, and that the thickness of the layer can be kept small.

The method according to the invention will now be described in more detail. Finely ground aluminum-oxide powder ($Al_2O_3$), tungsten-oxide powder ($WO_3$) and chromium-oxide powder ($Cr_2O_3$) are intimately mixed. With this mixture and additions of aluminum nitrate, magnesium nitrate, ethanol and water, a coating bath of green color is prepared. The heaters dipped into this bath are covered with insulating compound by an electrophoretic process. This insulating compound consists of the insulating material aluminum oxide, the high-melting metal tungsten, and an addition of chromium which is of importance during the sintering of the insulating layer. Through an electrolytic process which takes place simultaneously with the electrophoretic process and during which hydrogen is formed at the cathode, the insulating layer becomes porous whereby the heat-radiating surface of the heaters is enlarged. Following the coating process, the heaters are freed from loosely adhering aluminum oxide by being dipped into a suitable liquid such as methanol. The heaters are then dried and finally sintered at about 1,600°C in a nitrogen-hydrogen atmosphere. This results in a highly insulating greyish black mixed crystal. During sintering, the aluminum oxide tends to become sandy. By the addition of chromium it is precipitation-hardened and given a definite elasticity.

What is claimed is:

1. A method of producing a dark colored heat radiating layer of insulating material for heaters of indirectly heated cathodes, characterized in that aluminum-oxide powder is intimately mixed with tungsten-oxide powder and chromium-oxide powder, that a coating bath is prepared with said mixture and additions of aluminum nitrate, magnesium nitrate, ethanol and water, that the heaters dipped into said coating bath are coated electrophoretically with a porous, dark colored heat radiating layer of insulating material, with electrolysis taking place simultaneously, and that the heaters are then rinsed, in known manner, in a suitable liquid such as methanol, dried, and finally sintered in a nitrogen-hydrogen atmosphere at about 1,600°C.

2. The method according to claim 1, characterized in that the powdery mixture consists of about 86% by weight of aluminum oxide, about 10% by weight of tungsten oxide, and about 4% by weight of chromium oxide.

* * * * *